US008449410B1

(12) United States Patent
Kaufman

(10) Patent No.: US 8,449,410 B1
(45) Date of Patent: May 28, 2013

(54) SPORTS GRIP SENSOR

(76) Inventor: Alexander Kaufman, Aspen, CO (US)

( * ) Notice: Subject to any disclaimer, the term of this patent is extended or adjusted under 35 U.S.C. 154(b) by 0 days.

(21) Appl. No.: 13/136,898

(22) Filed: Aug. 12, 2011

Related U.S. Application Data

(63) Continuation-in-part of application No. 12/426,120, filed on Apr. 17, 2009, now abandoned.

(51) Int. Cl.
*A63B 49/08* (2006.01)

(52) U.S. Cl.
USPC ..... 473/549; 473/553; 473/459

(58) Field of Classification Search
USPC ..... 473/524, 549–553, 459, 463, 201, 473/202
See application file for complete search history.

(56) References Cited

U.S. PATENT DOCUMENTS 3,323,367 A * 6/1967 Searle ..... 473/202
4,870,868 A * 10/1989 Gastgeb et al. ..... 73/649
4,930,785 A * 6/1990 Mills ..... 473/202
5,221,088 A * 6/1993 McTeigue et al. ..... 473/201
5,226,650 A * 7/1993 Suttner ..... 473/463
5,439,216 A * 8/1995 Ganger, Sr. ..... 473/463
5,439,217 A * 8/1995 Ganger, Sr. ..... 473/202
5,542,676 A * 8/1996 Howe et al. ..... 473/202
5,681,993 A * 10/1997 Heitman ..... 73/379.02
6,716,034 B2 * 4/2004 Casanova et al. ..... 434/252
7,362,231 B2 * 4/2008 Bos ..... 340/665
2007/0202765 A1 * 8/2007 Krans et al. ..... 442/301
2008/0274819 A1 * 11/2008 Caldwell et al. ..... 473/213

* cited by examiner

*Primary Examiner* — Raleigh W Chiu
(74) *Attorney, Agent, or Firm* — Albert O. Cota

(57) ABSTRACT

A sports training device that includes a pressure sensor mounted on the hand grip of a sports implement such as a tennis racket or a golf club. The device utilizes a piezoelectric force sensor to monitor the grip pressure in a circular sensing area located where the palm meets the index finger. The piezoelectric sensor varies its resistance inversely with the force applied and is connected to an operational amplifier that uses a variable resistor to deliver an output voltage proportional to the force applied. This voltage triggers a vibrating motor that alerts the user that an excessive pressure has been applied to the hand grip. The exact amount of pressure for each player and the sports equipment used will vary but can be adjusted to signal when the pressure is too great for the particular use.

8 Claims, 5 Drawing Sheets

SPORTS GRIP SENSOR

This application is a continuation-in-part (CIP) of application Ser. No. 12/426,120 filed Apr. 17, 2009 now abandoned.

TECHNICAL FIELD

The invention generally pertains to devices for measuring the gripping force being applied by the hand to the handle of a tennis racket or a golf club. More particularly the invention pertains to a sports grip sensor that utilizes a piezoelectric sensor that measures the handle-applied force. When the applied force exceeds a predetermined value an alarm is activated indicating that the user has applied an excessive handle gripping force.

BACKGROUND ART

There are various tennis and golf training devices in the prior art that help to provide players with the correct wrist motion during a swing. These devices however, do not address hand grip forces which directly affect the swing. Measuring forces exerted on devices by the human hand is a complex and troublesome proposition. Since the hand is a complex mechanism, the actual hand forces generated are correspondingly complex and must be measured over a specific application area in order to provide a meaningful force. Measuring the force is also and expensive to measure with any reasonable accuracy.

In the past force measurements have not been attempted except by expensive and complicated machines for a very limited number of purposes. These machines are not very practical and cannot be used in a wide variety of applications. When these machines are used on a specific application, the force output is difficult to interpret in a meaningful manner. A further problem with these machines is that they are not portable and can not be used by the mass public because of their cost, size and complexity.

A search of the prior art did not disclose any literature or patents that read directly on the claims of the instant invention. However, the following U.S. patents are considered related.

| Pat. No. | INVENTOR | ISSUED |
|---|---|---|
| 5,681,993 | Heitman | 28 Oct. 1997 |
| 5,439,217 | Ganger, Sr. | 8 Aug. 1995 |
| 5,439,216 | Ganger, Sr. | 8 Aug. 1995 |
| 5,221,088 | McTeigue, et al | 22 Jun. 1993 |

The U.S. Pat. No. 5,681,993 discloses a plurality of force sensors disposed at predetermined pressure points between the human hand and an object to which a force is to be applied. A conversion device is provide that converts the outputs of the force sensors into audible sound frequencies which vary in proportion to the force applied and the location of the force. The conversion device also converts the output of the force to vibratory outputs or electrical currents that vary in proportion to the force level and location of the force.

The U.S. Pat. Nos. 5,439,217 and 5,439,216 each disclose a device that assures a player that a proper grip is being applied to racket handle or golf club. The device utilizes a membrane switch that is connected to a portable power source and that as couplet to an audible alarm that is activated when the switch closes. The alarm indicate that an excessive handle grip force is being applied to the handle.

The U.S. Pat. No. 5,221,088 discloses a sports training aid having a pair of foot sensors that produce measurement signals indicative of the weight applied to each foot sensor. The training aid compares the measurement signals with a specified range of values and produces audible sounds indicative of the relationship between the measurement signals and the specified range of values. Thus, providing the user of the training aid with immediate audible feedback regarding weight shifts.

DISCLOSURE OF THE INVENTION

Generally speaking, in accordance with the invention, a sports training device including a pressure sensor mounted in the grip of a tennis racket, or golf club is provided. The device is adjustable so that the player can fine-tune the sensor to alert at the correct grip tightness. This variable pressure sensor is connected to an alarm that will immediately notify the user when the grip is too tight. The exact amount of pressure for each player and the sports equipment used will vary widely, but can be adjusted to signal when the pressure is too great for the particular use. The device is suitable for grips of a tennis racket or golf clubs.

The sports grip alerts the player when squeezed too tightly by vibrating or issuing an alarm when the sensor is tripped. A piezoelectric force sensor monitors the grip pressure in a circular sensing area located under where palm meets the index finger. This location provides reliable pressure during a swing, but more sensors may be placed around the entire handle for different sports and to improve the precision of the sensor.

The piezoelectric sensor varies its resistance inversely with force applied. It is connected to an operational amplifier that uses a variable resistor to deliver an output voltage proportional to the force applied. This voltage triggers a vibrating motor to spin, thus alerting the user that he or she has squeezed too hard.

According, it is an object of the invention to provide a device that monitors a player's grip during swings.

It is another object of the invention to provide a device to alert a player when he or she grips too tightly during a swing.

It is a further object of the invention to provide a training device that is adjustable and suitable for a variety of players and sports.

It is yet another object of the invention to provide a training device having a pressure sensor mounted on the racket handle that is adjustable so that the player can fine-tune the racket to alert at the correct grip tightness.

It is yet further object of the invention to provide a training device to improve grip tightness that is compact and easy to use.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is had to the following description taken in connection with the accompany drawing(s), in which.

BEST MODE FOR CARRYING OUT THE INVENTION

Figure 1:
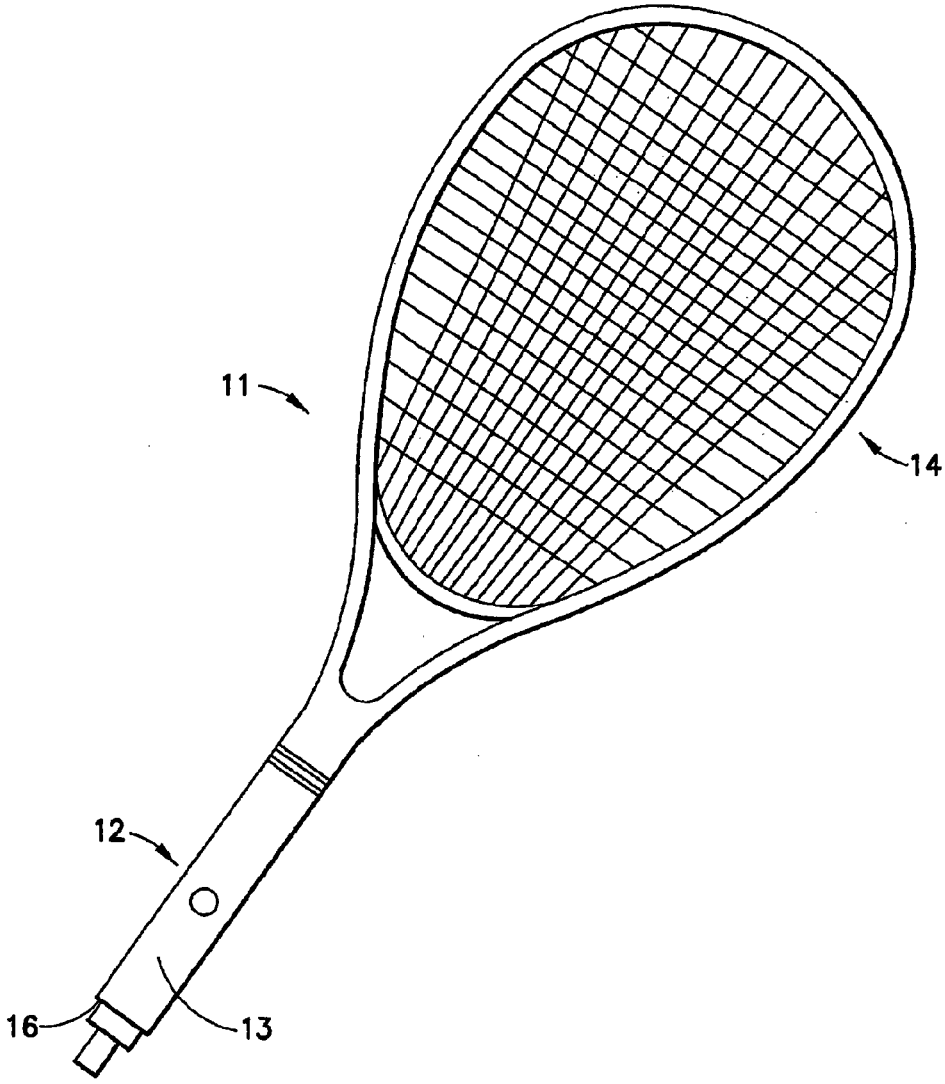
FIG. 1 is a perspective view of a tennis racket including a grip sensor constructed and arranged in accordance with the invention.
Figure 3:
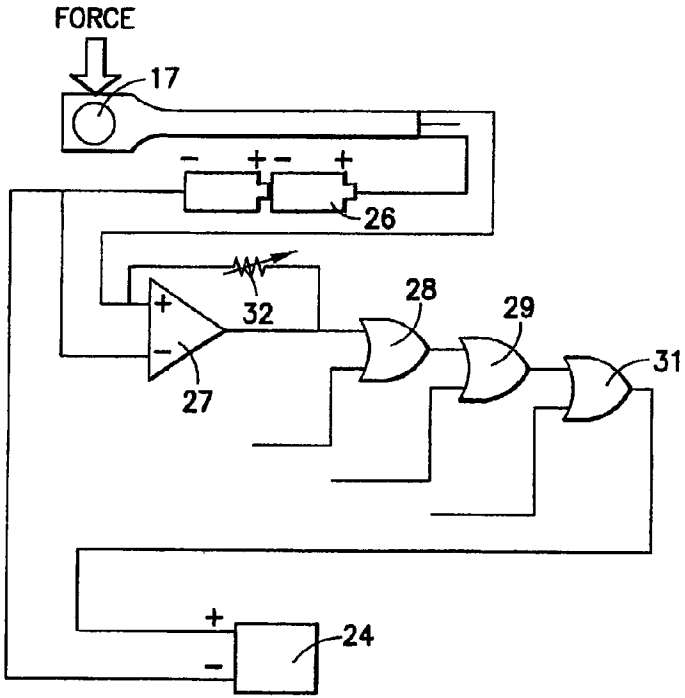
FIG. 3 is a schematic of a simple circuit showing the electrical connections for the grip sensor of FIG. 2.
Figure 6:
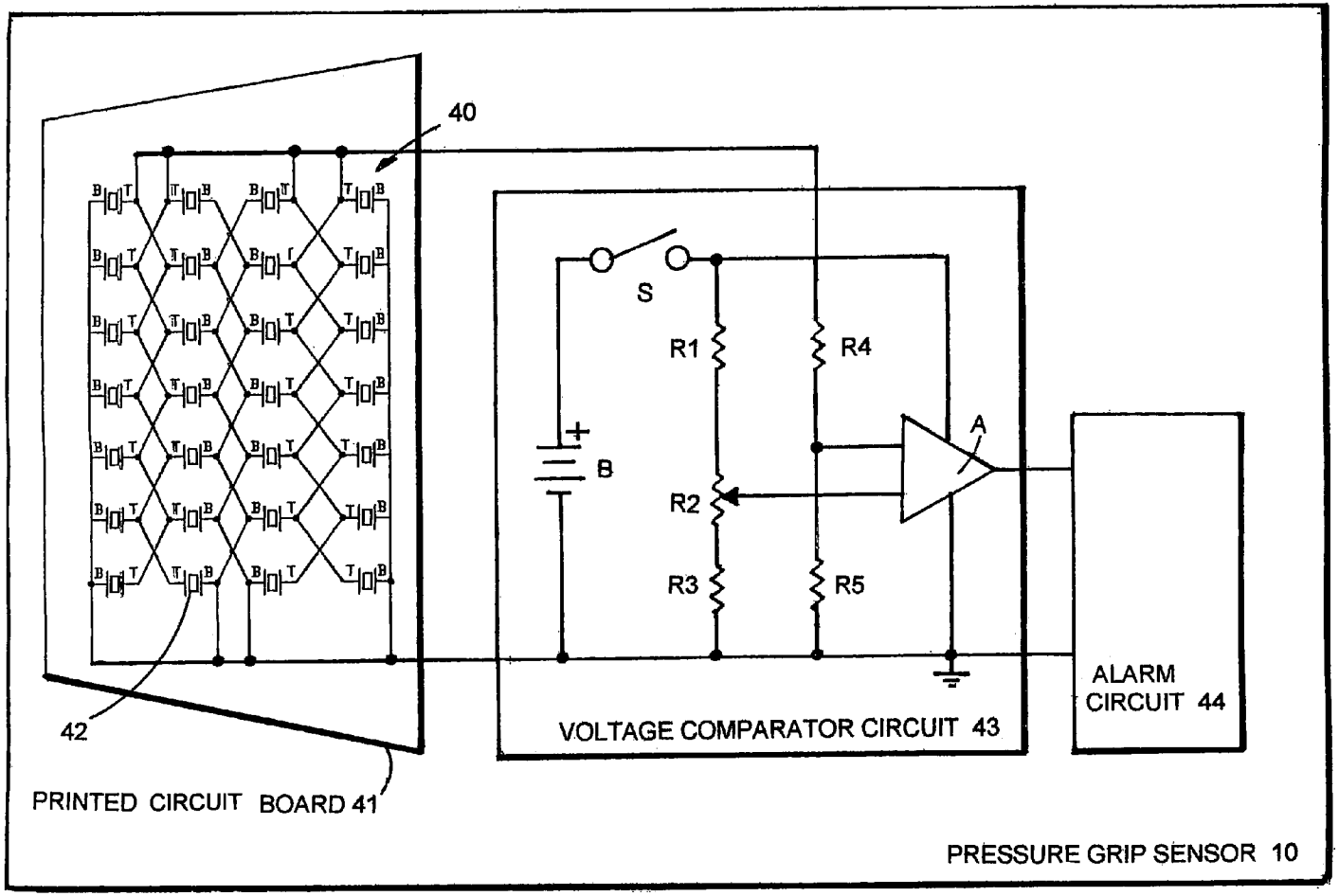
FIG. 6 is a schematic diagram of a second design for the grip sensor.

The best mode for carrying out the invention is presented in terms of a preferred embodiment for a sports grip sensor that is disclosed in two design configurations. The first design is shown in FIGS. 1-5 and the second design is shown in FIGS. 1 and 6. Both design configurations utilize a sports grip sensor that activates an alarm when a user of an athletic device such as a tennis racquet or a gulf club is applying an excessive force to the sports grip.

Figure 2:
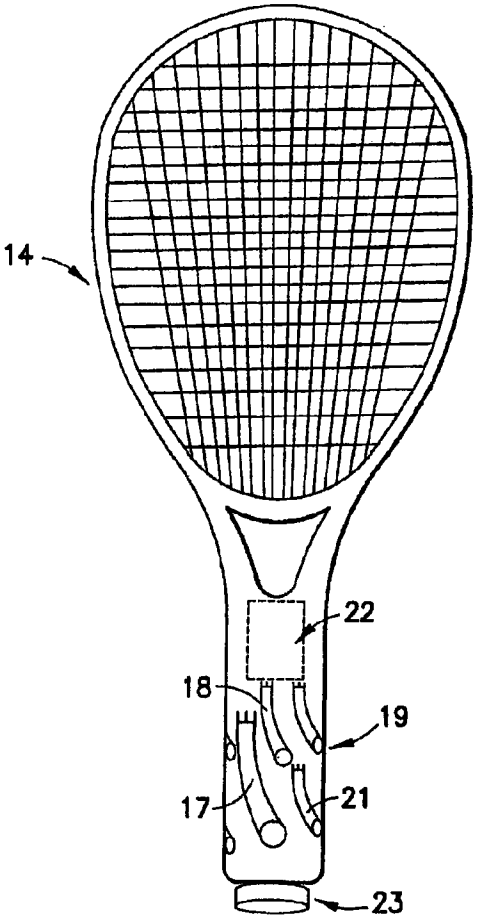
FIG. 2 is a schematic view showing the elements of the grip sensor in the tennis racket of FIG. 1.

The first design, as shown in FIG. 1, is comprised of a tennis racket 11 having a handle 12 with a grip handle 13 and a racket head 15. The handle 12 includes a grip sensor 16. The details of grip sensor 16 are shown in FIG. 2. Grip sensor 16 includes a pattern of piezoelectric force sensors 17, 18, 19 and 21 placed within the grip handle 13 together with an electrical circuit 22. Handle 12 also includes a sensitivity adjustment knob 23 operatively connected to electrical circuit 22.

The grip sensor 16 alerts a player when grip 13 is squeezed too tightly by vibrating when one of the sensors is tripped. Each sensor is comprised of a piezoelectric force sensor that monitors the pressure on grip 13. A small circular sensing area is located under where the palm substantially meets the index finger. This location provides reliable pressure during a tennis or golf swing.

A plurality of sensors 16 can also be placed around the entire handle to improve the precision of the sensor. When a plurality of sensors 16 are utilized they are arranged in an anatomical pattern that corresponds with the placement of the user's fingers and palm on the grip handle 13. Additionally, to provide an optimum interface the sensors and the handle, the sensors can be designed with a lower surface that conforms to the contour of the sport grip handle 12.

The force sensors used by the sport grip are comprised of ultra-thin and flexible printed circuits. These paper-thin force sensors can measure force between almost any two surfaces and are durable enough to stand up to sports environments due to their construction, flexibility and force measurement ability. Such sensors are available to measure forces in the range of from zero to 100 pounds.

The sensors include a substrate constructed of two layers of a polymer film, such as a polyester film. A conductive material, such as silver is deposited in the form of a circle or other suitable pattern, followed by a layer of a pressure sensitive ink. A suitable adhesive is then used to laminate the two layers of substrate and electrode together to form an individual sensor. The silver circle or pattern on top of the pressure-sensitive ink defines the active sensing area of the sensor. Silver or other conductive material extends from the sensing area to the connectors at one end of the sensor, thereby forming the conductive leads.

Each piezoelectric sensor varies its resistance inversely with force applied and is connected to an operational amplifier that uses a variable resistor to deliver an output voltage proportional to the force applied. This voltage triggers a vibrating motor 24 to spin, thus alerting the user that they have squeezed the handle too hard. The system is powered by a battery. In an exemplary embodiment, 5 n-type batteries 26 provide a voltage into sensor 17 of −3 V and a voltage of 4.5 V into an inverting operational amplifier 27 to produce an analog output based on the sensor resistance with additional sensors 18, 19, and 21 connected to operational amplifiers 28, 29 and 31 for controlling vibrator 24 as shown in the schematic illustration of FIG. 3 how sensors 17, 18, 19 and 21 are connected to power source 26 and vibrator 24.

Figure 4:
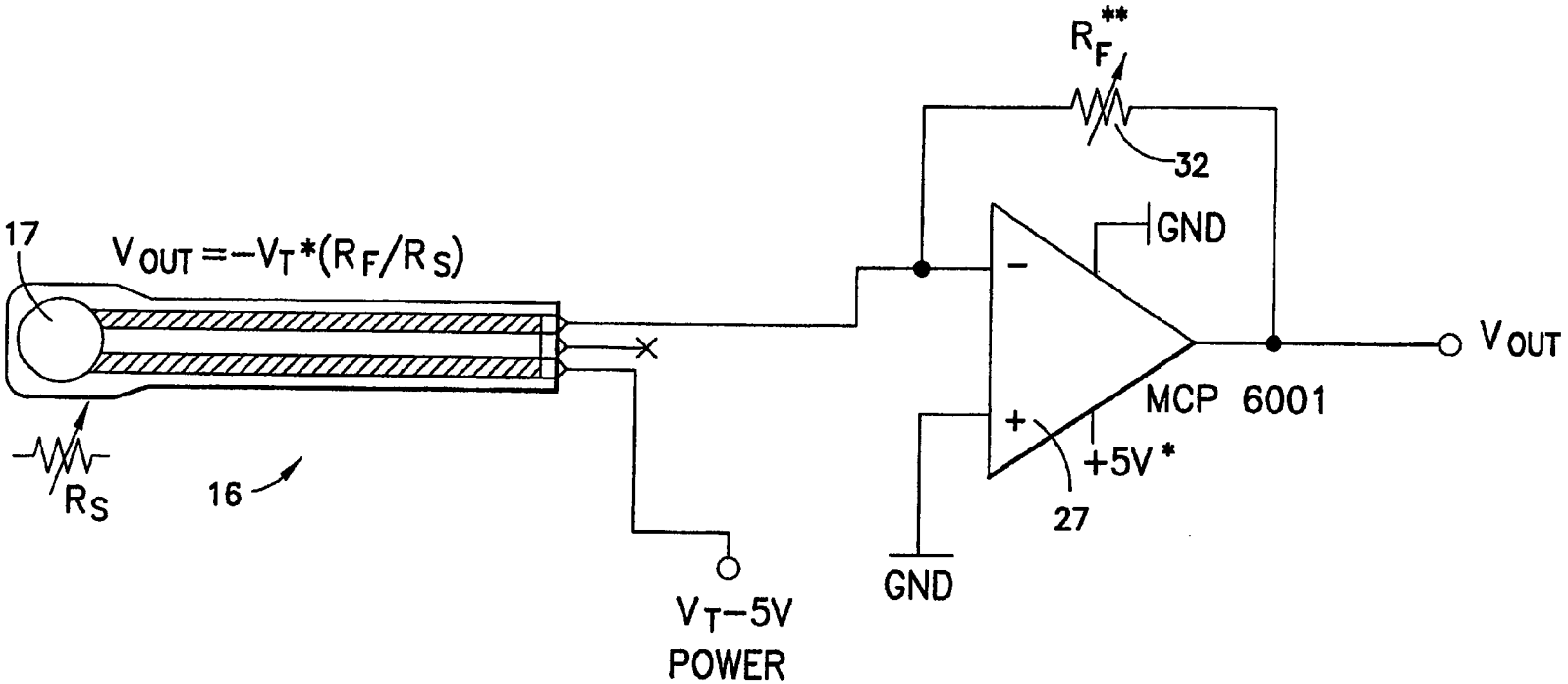
FIG. 4 is a force to voltage circuit driven by a −5V DC excitation voltage for use with the grip sensors.
Figure 5:
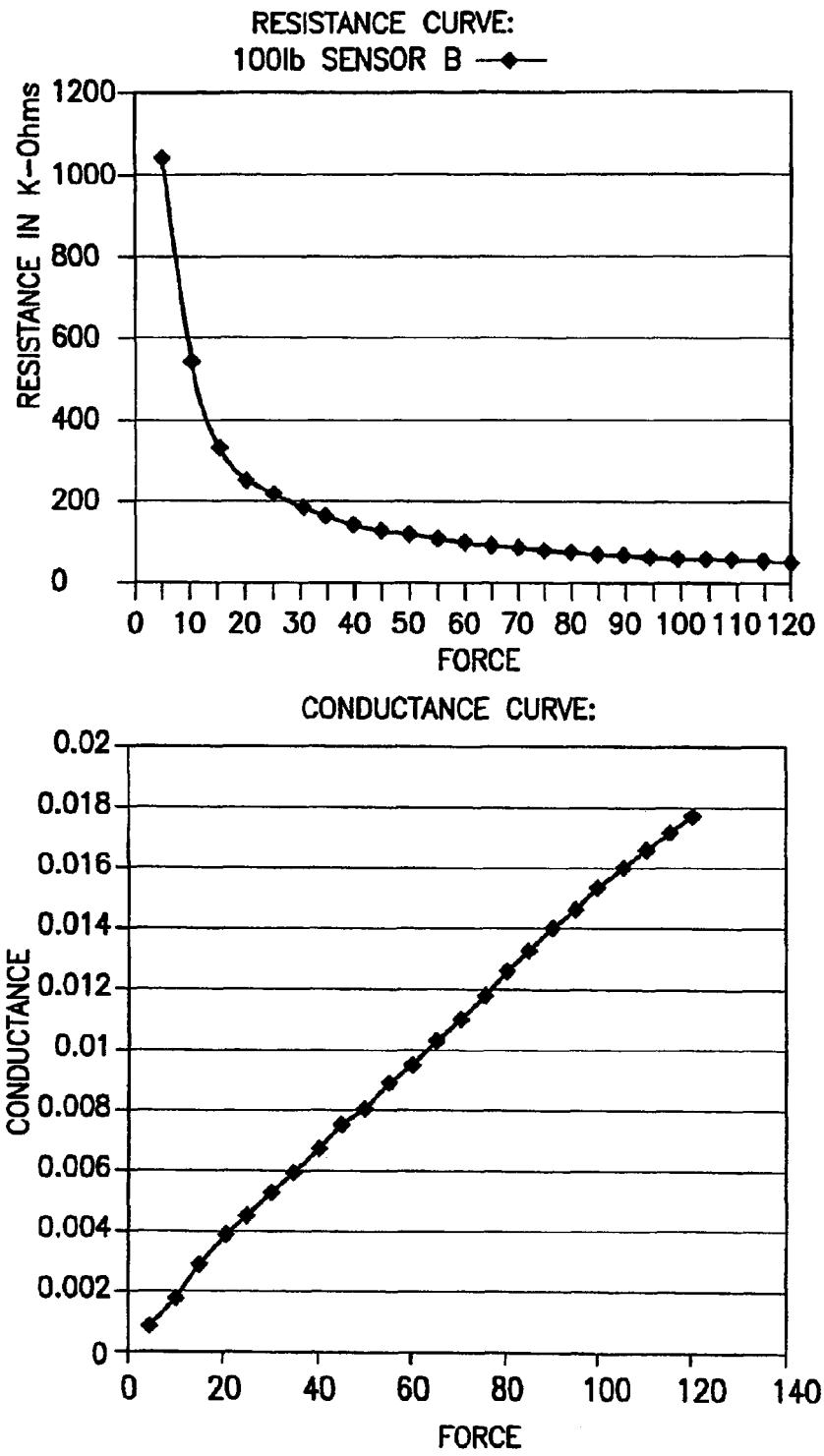
FIG. 5 are a resistance curve and a conductance curve for the circuit of FIG. 5.

One such commercially available sensor is a FlexiForce brand sensor from TekScan, Inc. of South Boston, Mass. The Tekscan sensors operate in the circuit of FIG. 4 and have the resistance vs. force curve and conductance vs. force curve shown in FIG. 5. In FIG. 4, the following applies: $V_{out}=-V^*(R_F/R_S)$.

Grip sensor 17 has a 1 meg-ohm variable resistor 32 coupled to adjustment knob 23 used to control the sensitivity of the sensors. A 20 mA relay is connected to the output voltage of the operational amplifier to power the vibrator. Details of the sensor circuit are set forth in U.S. Pat. No. 6,272,936, the contents of which is incorporated herein by reference in its entirety.

The second design configuration of the pressure grip sensor 10, as shown in FIG. 6, is comprised of three major elements: a piezoelectric array 40, a voltage comparator circuit 42 and an alarm circuit 43.

The piezoelectric array 40, as shown in FIG. 6, is mounted on a flexible printed circuit board (PCB) 41 having a trapazoidal shape that allows the PCB to conform to the curved radial shape of the grip handle 12. The trapazoidal shape, allows the two ends of the flexible PCB 41 to abut when the PCB 41 is attached to the grip handle 12. The PCB 41 can also be designed to have on one side an adhesive that allows the PCB 41 to be easily attached to the grip handle 12. Alternatively, one side of the PCB can have a peel and stick coating that also allows the PCB 41 to be easily attached to the grip handle 12.

As shown in FIG. 6, the piezoelectric array 40 is comprised of a multiplicity of piezoelectric sensors 42 that are connected in parallel in random clusters. This wiring scheme assures that in the event one of the sensor traces opens, the remaining sensors will continue to function. If the sensors are wired in series and a trace opens the entire set of piezoelectric sensors 42 would become inoperative. The output of the piezoelectric array 40 which is indicative of the force being applied to the grip handle 12, is applied to the voltage comparator circuit 43.

The sports grip 10 has a grip handle 12 having a hollow rear section, a curved radial shape and a grip covering. The hollow section is dimensioned to allow the voltage comparator circuit 43 to be inserted and attached by an attachment means, such as an adhesive or a threaded or friction cap.

The voltage comparator circuit 43, as shown in FIG. 6, is comprised of a switch S, an operational amplifier A, a battery B, and a set of resistors R1-R5 wherein resistor R2 consists of a potentiometer. The circuit 43 becomes operational when the switch S closes to allow the voltage from the battery B to be applied to the comparator circuit 43 concurrently with the application of the output voltage applied from the PCB 41. Resistors R4 and R5 create a first voltage divider circuit that presets the reference voltage applied to pin 2 on the operational amplifier A. Likewise, resistor R1 and R3 in combination with potentiometer R2 create a second adjustable voltage divider that produces an adjusted voltage that is applied to pin 1 on the operational amplifier A. When the grip handle 12 is squeezed by a user a voltage is produced by the piezoelectric array 40 which is applied to pin 2 on the operational amplifier A. If the applied voltage exceeds the reference voltage applied to pin 1 on the operational amplifier A, the operational amplifier A changes state and activates the alarm circuit 44 which can consists of either an audio alarm, a vibrator or a combination thereof.

This disclosure provides a product that monitors a player's grip during swings and alerts the player when they have gripped the handle too tightly. Correct grip pressure is essential to a good swing and it is difficult to diagnose a grip that is too tight.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawing (s) shall be interpreted as illustrative and not in a limiting sense.

The present invention may be embodied in other specific forms without departing from the spirit or essential attributes of the invention.

The invention claimed is:

1. A sports grip comprising:

a) a grip handle having a hollow section, a curved radial shape and a grip covering, b) a piezoelectric array that is mounted on a flexible printed circuit board (PCB) that conforms to the curved radial shape of the grip handle, wherein said piezoelectric array produces an output that is indicative of the force being applied to the grip handle by a user, c) a voltage comparator circuit that is inserted into and attached therein to the hollow section of the grip handle, wherein said circuit has an input and an output, wherein the input is connected to the output applied from said piezoelectric array, and d) an alarm that is connected to the output from said comparator circuit, wherein when a user applies a grip force to the grip handle said piezoelectric array produces an output that is applied to said comparator circuit, if the user-applied force exceeds a preset threshold level, said comparator circuit produces an output that is applied to and activates the alarm circuit indicating that the user is applying an excessive force to the grip handle.

2. The sports grip as specified in claim 1 wherein said piezoelectric array is comprised of a multiplicity of piezoelectric sensors that are connected in parallel in random clusters.

3. The sports grip as specified in claim 2 wherein said flexible PCB has a trapezoid shape that conforms to the curved radial shape of the grip handle, wherein the trapazoidal shape allows the two ends of the flexible printed circuit to abut when the flexible PCB is attached to the grip handle.

4. The sports grip as specified in claim 3 wherein the flexible PCB further comprising on one side an adhesive that allows the flexible PCB to be easily attached to the grip handle.

5. The sports grip as specified in claim 1 wherein the flexible PCB further comprising on one side a peel and stick coating that allows the flexible PCB to be easily attached to the grip handle.

6. The sports grip as specified in claim 1 wherein said voltage comparator circuit (42) is comprised of a switch (S), an operational amplifier (A), a battery (B), and resistors (R1-R5), wherein said voltage comparator circuit (42) functions as follows:

a) when switch (S) closes power is applied to the voltage comparator circuit (42) by the battery (B), b) resistors (R4 and (R5) create a first voltage divider circuit that presets the reference voltage applied to pin (2) on the operational amplifier (A), and c) resistor (R1) and R3) in combination with potentiometer (R2) create second adjustable voltage divider that produces an adjusted voltage applied to pin (1) on the operational amplifier (A), wherein when the grip handle is squeezed by a user a voltage is produced by the piezoelectric array which is applied to pin (2) on the operational amplifier (A), wherein if the applied voltage exceeds the reference voltage applied to pin (1) on the operational amplifier (A) the operational amplifier (A) changes state and activates the alarm circuit (43).

7. The sports grip as specified in claim 1 wherein the alarm circuit is comprised of an audio alarm.

8. The sports grip as specified in claim 1 wherein the alarm circuit is comprised of a vibrator.

* * * * *